US006220155B1

(12) United States Patent
Kimura

(10) Patent No.: US 6,220,155 B1
(45) **Date of Patent: *Apr. 24, 2001**

(54) STENCIL MAKING DEVICE

(75) Inventor: Kaoru Kimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/296,243

(22) Filed: Apr. 22, 1999

(30) Foreign Application Priority Data

Apr. 30, 1998 (JP) ..... 10-120885

(51) Int. Cl.[7] ..... B41C 1/14
(52) U.S. Cl. ..... 101/128.4; 101/477
(58) Field of Search ..... 101/114, 116, 101/117, 118, 128.21, 128.4, 477

(56) References Cited

U.S. PATENT DOCUMENTS 3,977,512 * 8/1976 Teagarden et al. ..... 400/234
5,438,347 8/1995 Shishido et al. .
5,443,556 * 8/1995 Hasegawa et al. ..... 101/116
5,662,040 9/1997 Mori et al. .
5,694,841 12/1997 Sato .
5,893,324 * 4/1999 Kimura ..... 101/117

FOREIGN PATENT DOCUMENTS 0 841 184 5/1998 (EP) .

* cited by examiner

*Primary Examiner*—Ren Yan
(74) *Attorney, Agent, or Firm*—Kanesaka & Takeuchi

(57) ABSTRACT

A stencil making device includes supporting a supporting device for rotatably supporting a rolled stencil a sheet; perforating device for perforating the stencil sheet conveyed from the supporting device to form an image therein; a pair of rollers rotatably disposed between the supporting device and the perforating device to hold the stencil sheet therebetween; and a torque applying device attached to one of the rollers to apply a predetermined torque to the roller when it rotates.

8 Claims, 7 Drawing Sheets

STENCIL MAKING DEVICE

BACKGROUND OF THE INVENTION

1. Field of the Invention

The present invention relates to a stencil making device for perforating a stencil sheet supplied from a rolled stencil sheet.

2. Description of the Related Art

FIG. 7 illustrates a conventional stencil making device. A rolled base sheet S for stencil printing (hereinafter referred to as a stencil sheet S) is supported in a master holder 106. The stencil sheet S supplied from the rolled stencil sheet S is in a shape of a continuous strip. The stencil sheet S changes conveying direction while turning on a set guide shaft 100. Then, the sheet is sandwiched between a thermal head 101 and a platen roller 102, and subsequently held between an upper roller 104 and a lower roller 105 after turning on a roller 103, and then conveyed to an initial stop position.

When the stencil sheet S is conveyed, tension in an opposite direction to the conveying direction is exerted on the stencil sheet S by a back-tension unit 107 disposed to the master holder 106, so that a portion of the sheet sandwiched between the thermal head 101 and the platen roller 102 does not wrinkle. The rolled stencil sheet S is attached to the back tension unit 107.

While being perforated by the thermal head 101, the stencil sheet S is conveyed only by a driving force of the platen roller 102 holding the sheet on the thermal head 101. The perforated stencil sheet S is guided downward by the roller 103 to move to a reservoir box 108. The perforated stencil sheet S is stored in the reservoir box 108 until the perforation by the thermal head 101 finishes.

On completion of perforating, the thermal head 101 moves upward to release the stencil sheet S held on the platen roller 102. The perforated stencil sheet S is conveyed by the upper and the lower rollers 104, 105 until a leading end thereof reaches a clamp plate 110 of a printing drum 109. The leading end of the stencil sheet S is held on the printing drum 109 by the clamp plate 110. When the printing drum 109 rotates simultaneously with rotation of the upper and the lower rollers 104, 105, the stencil sheet S is conveyed and wound around the circumferential surface of the printing drum 109. After the sheet is wound around the drum, a cutter unit 111 cuts the stencil sheet S.

The present device combines stencil printing function with the stencil making function. A part of the constitution for stencil printing is not illustrated in the drawings. A part of a circumferential wall of the printing drum 109 is ink-permeable. Ink supplying means is disposed inside the printing drum 109 for supplying ink to an inner surface of the circumferential wall. Pressing means is disposed under the printing drum 109 for pressing printing sheet against the printing drum 109. When the printing drum 109 rotates, the printing sheet is supplied between the printing drum 109 and the pressing means at a predetermined timing, so that the printing sheet is pressed against an image area of the stencil sheet S. The ink supplied to the inner surface of the printing drum 109 passes through the circumferential wall of the printing drum 109, and then transferred to the printing sheet through perforations of the stencil sheet S to form an image thereon.

According to the conventional stencil making device as illustrated in FIG. 7, the back tension unit 107 comprises a silicon oil damper. The rolled stencil sheet S is perforated by a perforating section comprising the platen roller 102 and the thermal head 101, and conveyed to the downstream side. Then, the back tension unit 107 exerts back tension on the stencil sheet S held between the back tension unit 107 and the perforating section.

The tension changes according to a diameter of the rolled stencil sheet S. The tension is small when the diameter of the rolled stencil sheet S is long, and it increases as the diameter decreases. Torque required to rotate the silicon oil damper for exerting the back tension is constant. A product of the tension exerted on the stencil sheet unrolled from the most outer portion of the rolled stencil sheet and the diameter of the rolled stencil sheet is balanced with torque required to rotate the silicon oil damper. Accordingly, when the diameter of the rolled stencil sheet decreases, the tension exerted on the unrolled stencil sheet increases.

The increased tension exerted on the stencil sheet may cause a slip between the platen roller 102 and the stencil sheet S. If such a slip occurs, the stencil sheet moves in shorter distance than rotational distance of the platen roller 102. The slip results in shortening the size of the perforated area in the stencil sheet than a predetermined size (a size of an original), thereby causing shrinkage in print-image.

If torque of the silicon oil damper is set at smaller level to lower the tension exerted on the stencil sheet when the diameter of the rolled stencil sheet is shorter, the stencil sheet may wrinkle in perforating when the diameter of the rolled stencil sheet is longer since the tension exerted on the stencil sheet is excessively small.

The present invention is made in view of the aforementioned problems. An object of the present invention is to provide a stencil making device capable of exerting appropriate tension on the stencil sheet S in perforating to avoid wrinkling the stencil sheet.

SUMMARY OF THE INVENTION

A stencil making device as defined in the first aspect of the present invention comprises supporting means for rotatably supporting a rolled stencil sheet, perforating means for perforating the stencil sheet conveyed from the supporting means to form an image therein, a pair of rollers rotatably disposed between the supporting means and the perforating means to hold the stencil sheet therebetween, and torque applying means attached to one of the rollers to apply a predetermined torque to the roller when the roller rotates.

According to a stencil making device as defined in the second aspect of the present invention, in the stencil making device of the first aspect, the torque applying means is a torque limiter.

According to a stencil making device as defined in the third aspect of the present invention, in the stencil making device of the first aspect, the torque applying means is a damper.

According to a stencil making device as defined in the fourth aspect of the present invention, in the stencil making device of the first aspect, the pair of rollers comprises a tension roller rotatably disposed at a predetermined position and a nip roller vertically movably and rotatably disposed over the tension roller, the nip roller is urged downwardly to contact the tension roller, and the torque applying means provides the predetermined torque to the tension roller.

According to a stencil making device as defined in the fifth aspect of the present invention, in the stencil making device of the fourth aspect, the nip roller is urged to the tension roller by its self weight.

According to a stencil making device of the sixth aspect of the present invention, in the stencil making device of the fourth aspect, the stencil making device further comprises an elastic member to elastically urge the nip roller to the tension roller.

According to the aforementioned stencil making device, back tension exerted on the stencil sheet in perforating is constant regardless of the diameter of the rolled stencil sheet. Accordingly, the stencil sheet does not wrinkle in perforating and the size of perforated area in the stencil sheet does not shrink.

DETAILED DESCRIPTION OF PREFERRED EMBODIMENTS

One embodiment of the present invention will be explained referring to FIGS. 1 to 6.

Figure 1:
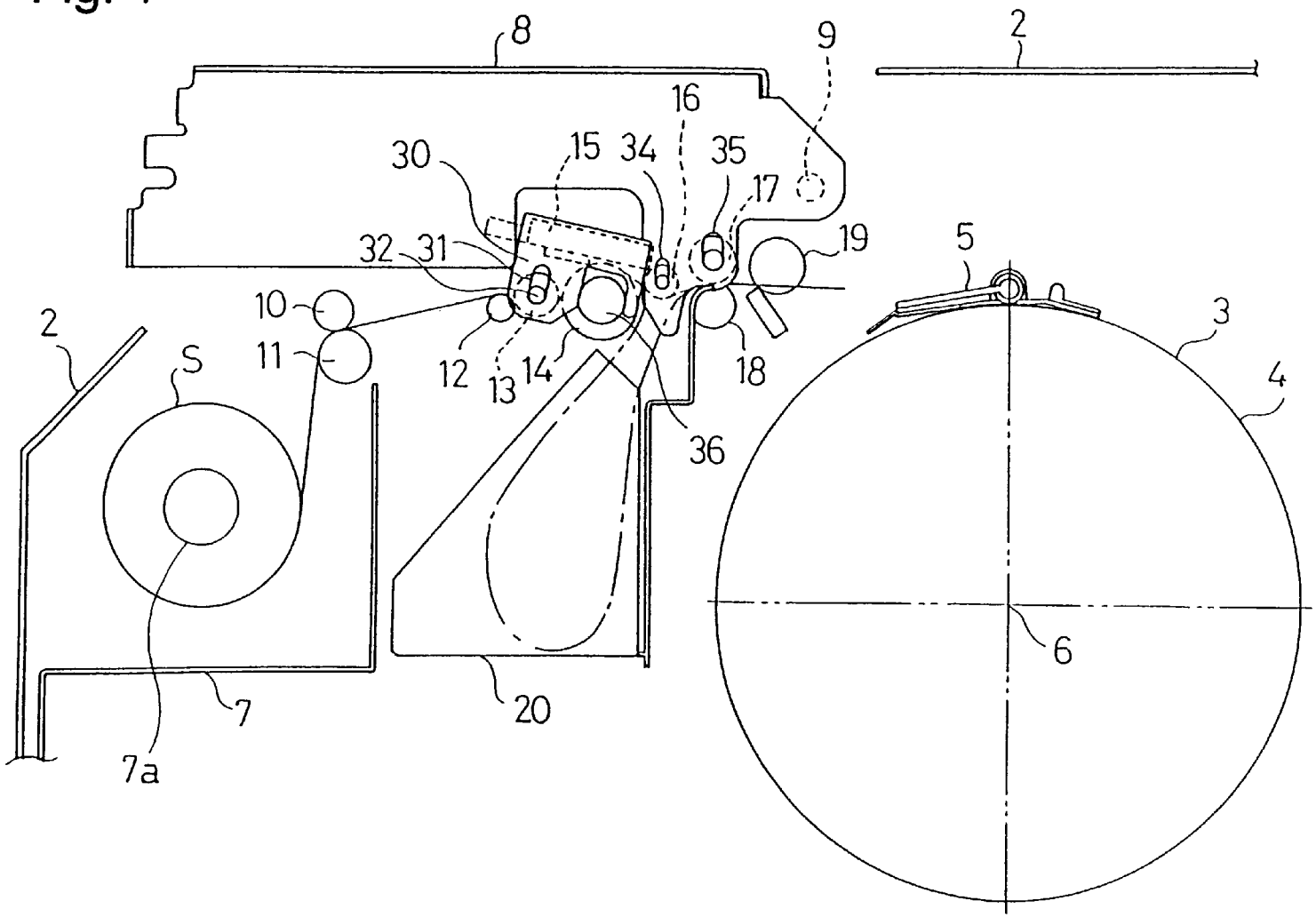
FIG. 1 is a sectional view of one embodiment of the present invention illustrating the entire constitution thereof.

A stencil making device 1 of the present embodiment combines a perforating function of thermally perforating a stencil sheet S by using a thermal head and a printing function of conducting stencil printing to printing paper by using the perforated stencil sheet S. As shown in FIG. 1, a printing drum 3 is placed inside a main frame 2. The printing drum 3 comprises a partially ink-permeable circumferential wall 4, a clamp plate 5 disposed to the outer circumferential surface of the circumferential wall 4 as clamping means, and ink supplying means (not shown) disposed to the inside of the circumferential wall 4 for supplying ink to the inner circumferential surface of the circumferential wall 4. The printing drum 3 is driven to rotate around a rotation axis disposed at a predetermined position parallel with a central axis 6 thereof. Pressing means (not shown) is placed under the printing drum 3 for pressing printing paper against the printing drum 3.

Inside the main frame 2, there is disposed a roll supporting section, i.e. a master holder 7. In the master holder 7, a rolled stencil sheet S is rotatably stored. The rolled stencil sheet S is fitted on a rotatable shaft 7*a*. The stencil sheet S is composed of a thermal film and a porous substrate attached to each other. A partial opening is formed in an upper surface of the main frame 2 of the present stencil making device. A pressing frame 8 is openably attached thereto by a support axis 9. Between the master holder 7 and the printing drum 3, from the master holder 7 side, successively aligned are a nip roller 10 and a tension roller 11, set guide shaft 12, an intermediate roller 13, a platen roller 14 and a thermal head 15 (hereinafter referred to as TPH 15), a guide roller 16, an upper load roller 17 and a lower load roller 18, and a cutter unit 19. The stencil sheet S is conveyed while passing through the rollers and so on, and perforated by the TPH 15. Inside the main frame 2, a reservoir box 20 for storing a perforated stencil sheet S therein is disposed below the platen roller 14 and the TPH 15 or the guide roller 16.

Figure 2:
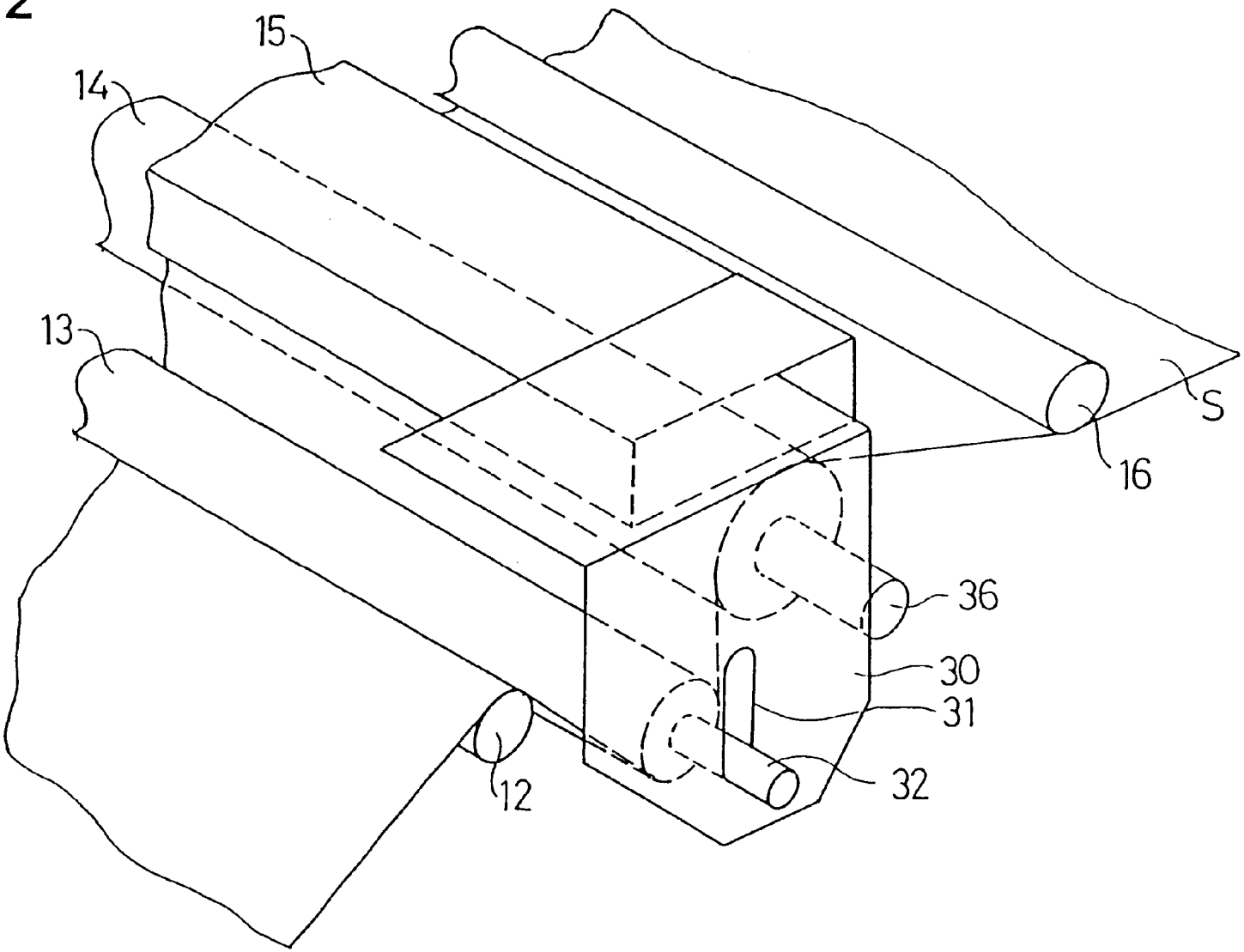
FIG. 2 is a perspective view illustrating a constitution in the vicinity of a thermal head (TPH) in one embodiment.

As shown in FIG. 1, the TPH 15 is attached to the pressing frame 8. As shown in FIG. 2, the TPH 15 has a shape of a plate that is longitudinal in a width-direction of the stencil sheet S. The TPH 15 is placed parallel with the width-direction of the stencil sheet S and contacted with an upper surface of the stencil sheet S. Further, the TPH 15 can approach or withdraw from the platen roller 1 when being driven by a driving mechanism not shown. The TPH 15 contacts the platen roller 14 while perforating the stencil sheet S, and withdraws from the platen roller 14 on completion of the perforating. The TPH 15 has a plural heat-emitting elements aligned parallel with the width direction of the stencil sheet S. The stencil sheet S is thermally perforated by the heat-emitting elements. In the present embodiment, the TPH 15 and the platen roller 14 constitute perforating means.

The platen roller 14 is disposed below the TPH 15 in the main frame 2. When the pressing frame 8 closes, the TPH 15 of the pressing frame 8 contacts the platen roller 14 of the main frame 2. The stencil sheet S sandwiched between the TPH 15 and the platen roller 14 is thermally perforated by the TPH 15 while being conveyed by the platen roller 14.

As shown in FIG. 1 and FIG. 2, a claw 30 is attached to each end of the TPH 15. As illustrated in FIG. 1, it may be recommended that the platen roller 14 be positioned to the TPH 15 when the claw 30 engages a shaft 36 of the platen roller 14. This claw 30 has a vertical slit 31 formed therein. A shaft 32 of the intermediate roller 13 movably engages the slit 31. The intermediate roller 13 can move vertically along the slit 31. Before the intermediate roller 13 in a direction of conveying the stencil sheet S, the set guide shaft 12 is placed as guiding means for guiding the stencil sheet S. The set guide shaft 12 is rotatably disposed to the main frame 2 side. The stencil sheet S supported between the set guide shaft 12 and the platen roller 14 is pressed downwardly to be convex by the self-weight of the intermediate roller 13.

As shown in FIG. 1, vertical slits 34 and 35 are formed in the pressing frame 8. The guide roller 16 and the upper load roller 17 are attached to the slits 34 and 35 respectively. The guide roller 16 and the upper load roller 17 are vertically movable and rotatable.

Figure 3:
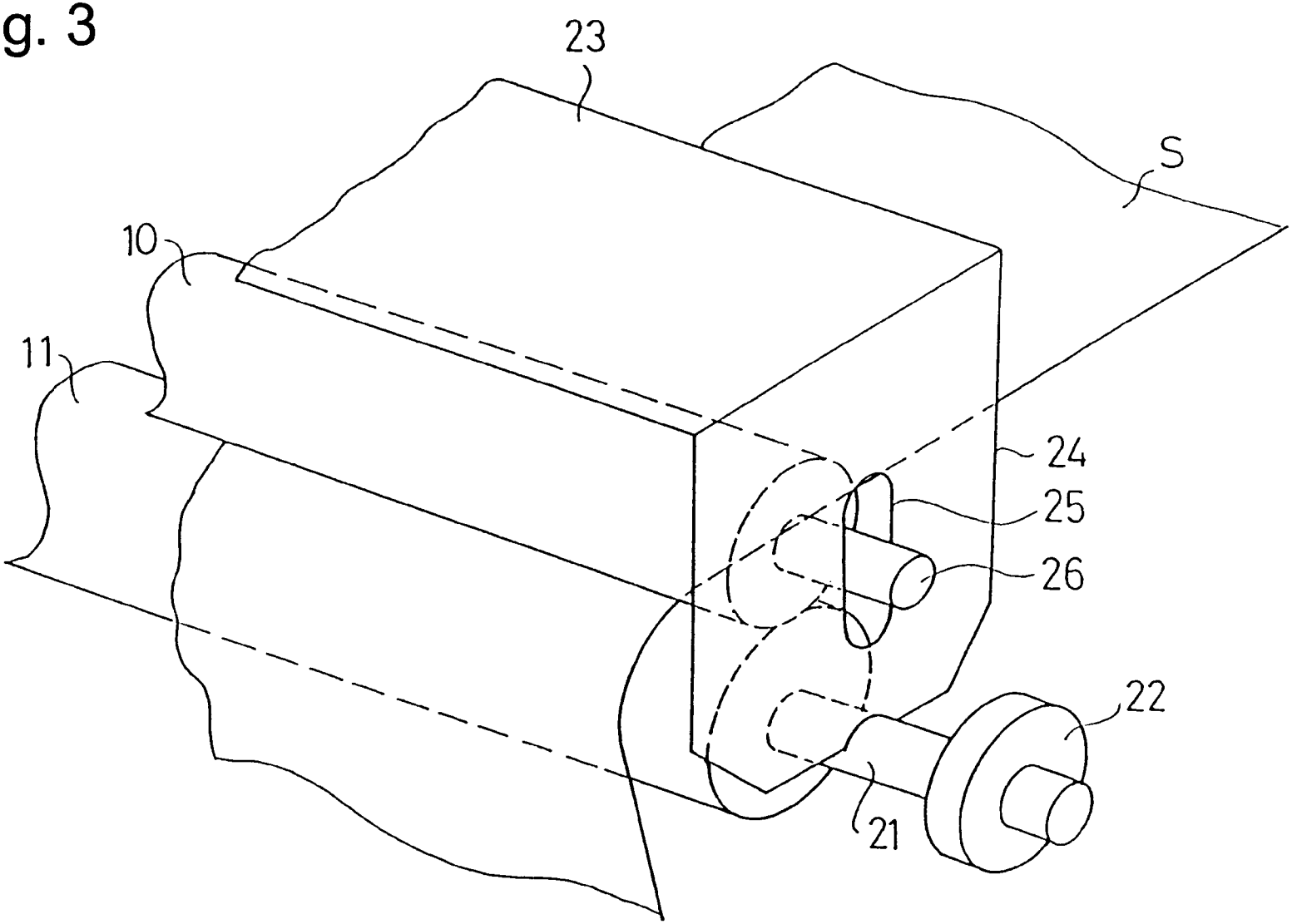
FIG. 3 is a perspective view illustrating a constitution in the vicinity of a tension roller and a nip roller in one embodiment.
Figure 4:
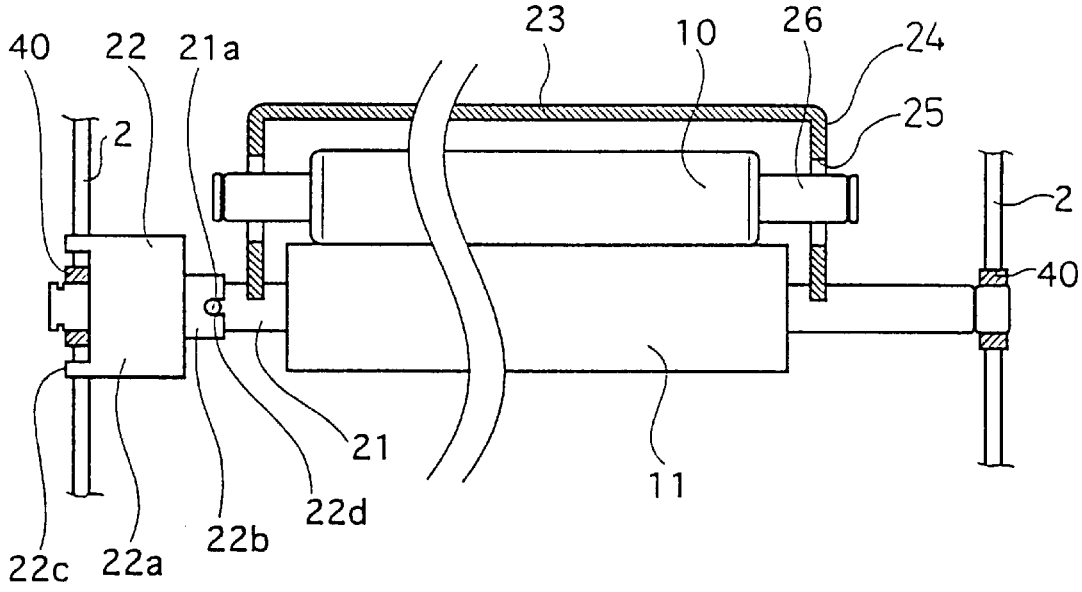
FIG. 4 is a sectional view illustrating a constitution in the vicinity of a tension roller and a nip roller in one embodiment.
Figure 5:
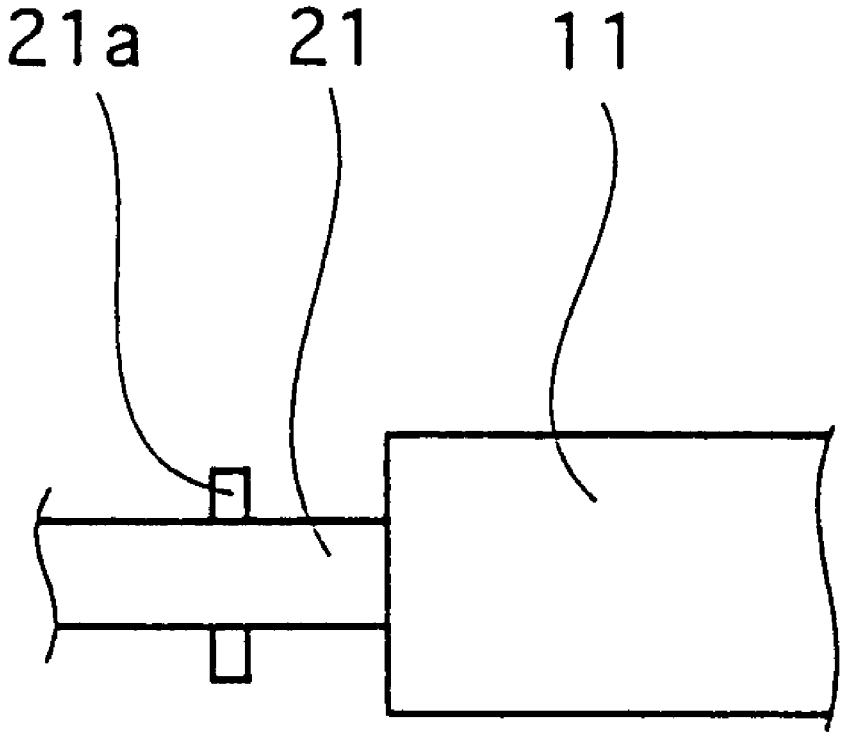
FIG. 5 is an elevation view illustrating a constitution of a shaft-end of a tension roller in one embodiment.

Referring to FIGS. 3,4, and 5, the nip roller 10 and the tension roller 11 will be explained. The pair of the rollers can exert an appropriate tension on the stencil sheet S in perforating, thereby preventing occurrence of wrinkles in the stencil sheet.

The nip roller 10 and the tension roller 11 are attached to the main frame 2 side. On a circumferential surface of the tension roller 11, a high-friction material such as rubber is disposed. Otherwise, the circumferential surface may be treated to gain high friction. Accordingly, the stencil sheet S is not likely to slip on the tension roller 11. As shown in FIG. 4, a shaft 21 of the tension roller 11 is rotatably supported by a bearing 40 at a predetermined position of the main frame 2.

As shown in FIG. 3, torque applying means, i.e. a torque limiter 22 is disposed to the shaft 21 of the tension roller 11. As shown in FIG.4, the torque limiter 22 comprises a cylindrical outer casing 22*a*, hollow and cylindrical inner casing 22*b*, and fixing claw 22*c*. The torque limiter 22 is fixed to the main frame 2 by the fixing claw 22*c*.

The shaft 21 of the tension roller 11 is coaxially fitted into the inner casing 22*b*. On one end portion of the inner casing 22*b*, two notches 22*d* are formed. As shown in FIG. 5, on one end portion of the shaft 21 of the tension roller 11, two protrusions 21*a* are formed. The protrusions 21*a* engage the notches 22*d* by inserting the end portion of the shaft 21 into the end portion of the inner casing 22*b*. The end portion of the shaft 21 protrudes outward from another end portion of the inner casing 22*b*. The end portion of the shaft 21 is rotatably supported by the bearing 40 at a predetermined position of the main frame 2.

The inner casing 22*b* rotates relative to the outer casing 22*a* when torque applied to the inner casing exceeds a predetermined value. Torque transmission mechanism of the torque limiter 22 may utilize a spring, friction between friction plates, or attraction and repulsion of a magnet. Such torque transmission mechanism loads a predetermined torque on the tension roller 11 when it rotates. A constant torque is applied to the stencil sheet S since the stencil sheet S does not slip on the tension roller 11 when being conveyed.

As shown in FIGS. 3 and 4, the nip roller 10 is disposed over the tension roller 11. A horizontal support plate 23 is fixed to the main frame 2. On both ends of the support plate 23, downward side plates 24 are disposed respectively. In each of the side plates 24, a vertical slot 25 is formed. Each end of a shaft 26 of the nip roller 10 is movably engaged with the slot 25. The nip roller 25 is vertically movable along the slot 25. In the present embodiment, the nip roller 10 is urged downwardly by its weight to contact the tension roller 11.

Figure 6:
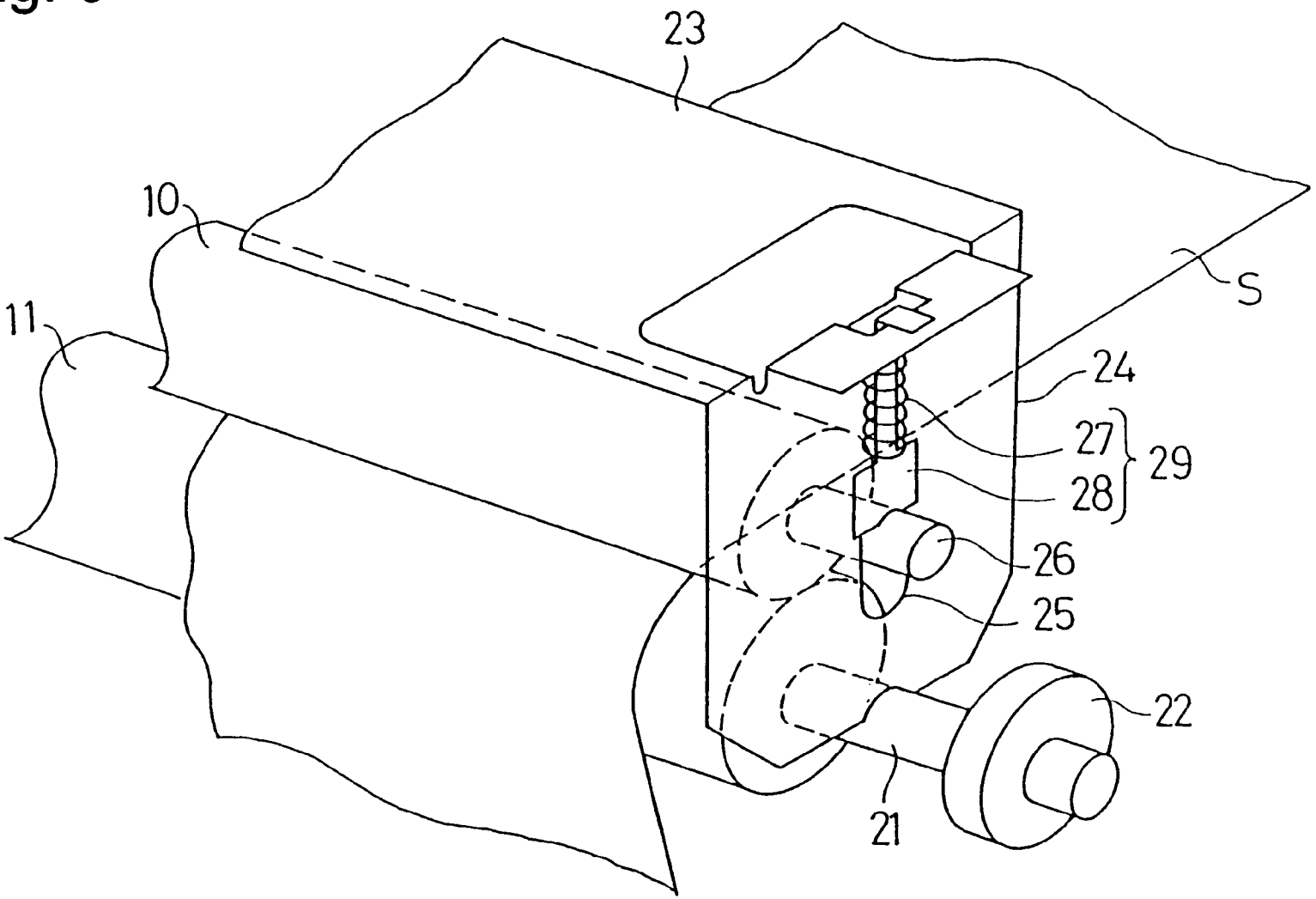
FIG. 6 is a perspective view illustrating a constitution in the vicinity of a tension roller and a nip roller in another embodiment.

As shown in FIG. 6, urging means 29 comprising a compression spring 27 and a pressing member 28 may be disposed to or around each of the side plates 24. Hence, the shaft 26 of the nip roller 10 is urged downwardly, and the nip roller 10 contacts the tension roller 11.

Since the torque limiter 22 is disposed on the shaft of the tension roller 11, the stencil sheet S held between the tension roller 11 and the nip roller 10 is conveyed between the platen roller 14 and the TPH 15 with a constant tension applied thereto regardless of diameter of the rolled stencil sheet S.

Next, perforating operation of the present device will be explained.

The stencil sheet S will be set through said rollers and so on. Firstly, the pressing frame 8 is opened. A continuous strip of the stencil sheet S is unrolled and provided from the rolled stencil sheet S stored in the master holder 7. The stencil sheet S is drawn to pass between the nip roller 10 and the tension roller 11. Further, the stencil sheet S is placed to contact each upper peripheral surface of the set guide shaft 12, the platen roller 14 and the lower load roller 18. And, the pressing frame 8 is closed. The stencil sheet S is then sandwiched between the TPH 15 and the platen roller 14.

In perforating, image information is given to the TPH 15. The TPH 15 forms perforated images in the stencil sheet S held against the platen roller 14 according to the image information. During the perforation, power for conveying the stencil sheet S is exerted only by the platen roller 14. The perforated stencil sheet S is guided downwardly by the roller 16 into the reservoir box 20. Until the perforation is finished in one operation, the perforated stencil sheet S is successively stored in the reservoir box 20.

In said perforating operation, the stencil sheet S provided from the rolled stencil sheet S passes through the tension roller 11 with the torque limiter 22 and the nip roller 10 urged toward the tension roller 11. Accordingly, a constant tension is always applied to the stencil sheet S moving toward the TPH 15.

The intermediate roller 13 deforms the stencil sheet S supported between the set guide shaft 12 and the platen roller 14 to be convex with self-weight thereof As stated above, a constant tension is applied to the stencil sheet S by the nip roller 10 and the tension roller 11 during perforating. Further, the intermediate roller 13 is vertically movable and contacts the upper surface of the stencil sheet S. Accordingly, the stencil sheet S with a constant tension exerted thereon lifts up the intermediate roller 13 while being conveyed, so that the shaft 32 of the intermediate roller 13 floats over the bottom of the slit 31. Therefore, the shaft 32 of the intermediate roller 13 is automatically adjusted parallel with the axis of the platen roller 14. The stencil sheet S does not slack while being conveyed. The stencil sheet S does not wrinkle after being perforated.

After perforating, printing is performed. The TPH 15 moves upward to leave the platen roller 14 below. The stencil sheet S held between the TPH 15 and the platen roller 14 is released. A leading end of the perforated stencil sheet S is transferred to the clamp plate 5 by the upper roller 17 and the lower roller 18. The leading end of the stencil sheet S is held on the printing drum 3 by the clamp plate 5. When the printing drum 3 rotates simultaneously with rotation of the upper and the lower rollers 17, 18, the stencil sheet S is conveyed and wound around the circumferential surface of the printing drum 3. After the sheet is wound around the drum, the cutter unit cuts the stencil sheet S.

When the printing drum 3 rotates, a printing sheet is supplied between the printing drum 3 and the pressing means at a predetermined timing. The printing sheet is pressed against an image area of the stencil sheet S by the pressing means. Ink supplied to the inner surface of the printing drum 3 passes through the circumferential wall of the printing drum 3, and then transferred to the printing sheet through perforations of the stencil sheet S. An image is formed on the printing sheet In the embodiment explained before, the torque limiter is used as torque applying means. A damper may be used as torque applying means as well. As the damper, a silicon-oil damper or a damper using viscous fluid or powder may be used.

The stencil sheet, while being conveyed by the platen roller, changes its speed in a predetermined range according to factors such as perforation rate. According to the changes in the speed, rotational speed of the pair of rollers, namely of the tension roller and the nip roller, also changes in a predetermined range. Accordingly, torque gained from the torque applying means, namely by the torque limiter, changes as well in the strict sense of the meaning. But such torquechange is only within a narrow range; the effect of the present invention is fully attained.

Figure 7:
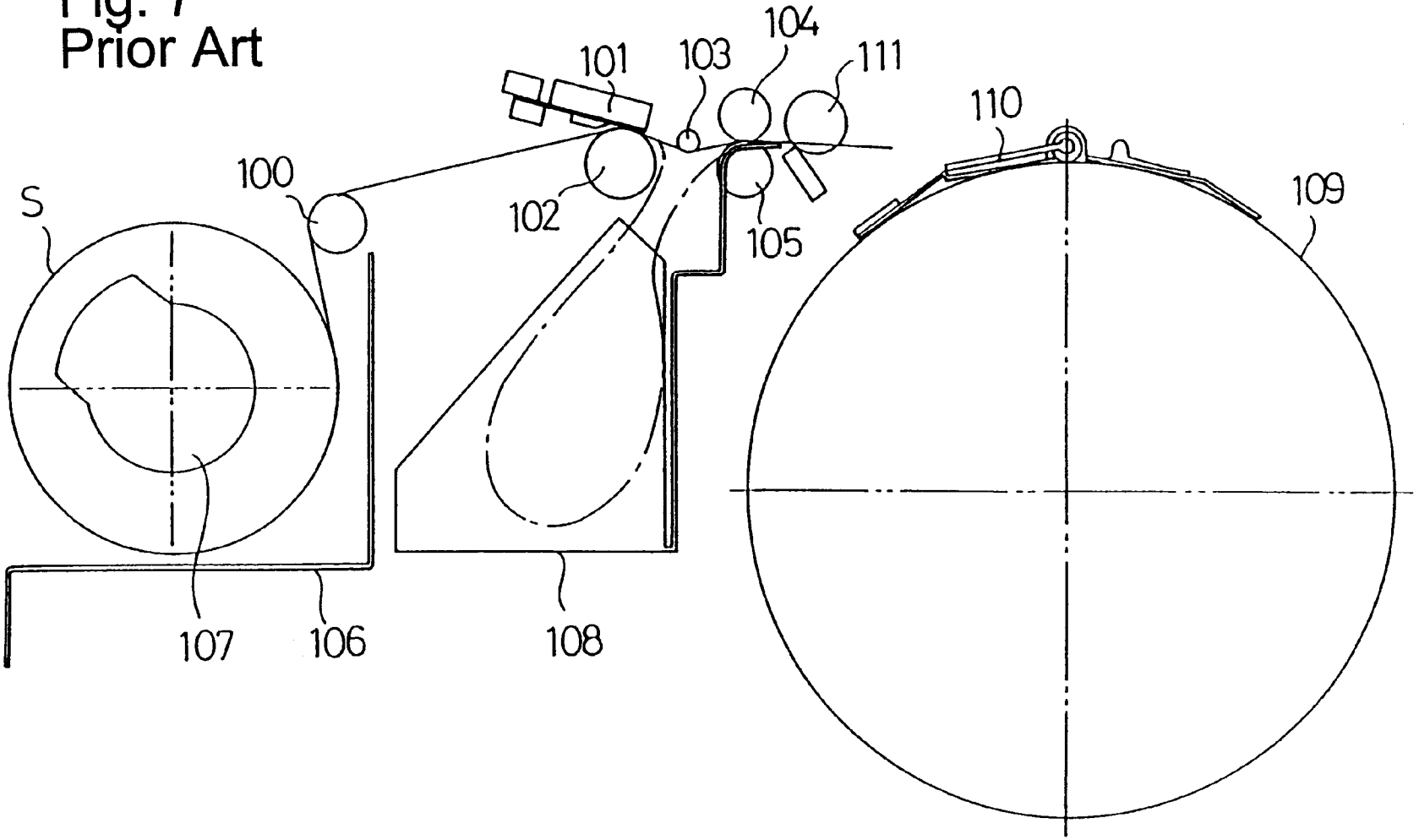
Fig. 7 Prior Art
FIG. 7 is a sectional view of an example of a conventional stencil making device.

In the aforementioned embodiment, the rolled stencil sheet S is rotatably supported in the master holder 7, and the silicon-oil damper as illustrated in FIG. 7 is not used there. The stencil making device with the torque applying means of the present invention may also include the torque damper as illustrated in FIG. 7 for preventing the rolled stencil sheet from slacking. In this case, if the torque of the silicon-oil damper is lower than that of the torque applying means (namely below 50%, preferably below 30%), the problems occurred in the case where only the conventional silicon-oil damper is used can be prevented. Namely, when the present invention includes the silicon-oil damper as illustrated in FIG. 7, this silicon-oil damper changes the tension in the stencil sheet according to the changes in the diameter of the rolled stencil sheet; therefore, if adequately low torque of the silicon-oil damper is employed, changes in the tension exerted on the stencil sheet can be restrained in a predetermined range.

According to the present invention, in the stencil making device, a pair of rollers is disposed between the supporting means and the perforating means for holding the stencil sheet therebetween, and the torque applying means is disposed to one roller of the pair. Hence, the back tension exerted on the stencil sheet during perforation is maintained constant regardless of the diameter of the rolled stencil sheet. Accordingly, the stencil sheet does not wrinkle during perforation, and the size of the perforated area does not shrink.

What is claimed is:

1. A stencil making device, comprising:

supporting means for rotatably supporting a rolled stencil sheet;

perforating means for perforating said stencil sheet conveyed from said supporting means to form an image therein;

a pair of rollers disposed between said supporting means and said perforating means to hold said stencil sheet therebetween, said rollers being rotated only when the stencil sheet is pulled outwardly;

torque applying means attached to one of said rollers to apply a predetermined torque to said roller when said roller rotates so that when the rolled stencil sheet is pulled outwardly between the pair of rollers, the predetermined torque is applied to the stencil sheet;

a frame for rotationally supporting the pair of rollers, said pair of rollers with the torque applying means being rotated only by the stencil sheet pulled outwardly; and an intermediate roller vertically movably situated between the perforating means and the pair of rollers, said intermediate roller being disposed on the stencil sheet held between the perforating means and the pair of rollers to provide a tension by its own weight when the stencil sheet is pulled outwardly.

2. A stencil making device as defined in claim 1, wherein said torque applying means is a torque limiter.

3. A stencil making device as defined in claim 1, wherein said torque applying means is a damper.

4. A stencil making device as defined in claim 1, wherein said pair of rollers comprises a tension roller rotatably disposed at a predetermined position and a nip roller vertically movably and rotatably disposed over said tension roller, said nip roller being urged downwardly to contact said tension roller, said torque applying means providing said predetermined torque to said tension roller.

5. A stencil making device as defined in claim 4, wherein said nip roller is urged to move to said tension roller by its self-weight.

6. A stencil making device as defined in claim 4, further comprising an elastic member to elastically urge said nip roller to said tension roller.

7. A stencil making device as claimed in claim 1, wherein said supporting means free rotatably supports the rolled stencil sheet to allow the stencil sheet to be freely pulled outwardly.

8. A stencil making device as claimed in claim 1, wherein said supporting means includes a damper for providing a resistance to the rolled stencil sheet when the rolled stencil sheet is pulled outwardly, said damper providing a torque less than 50% of a torque of the torque applying means.

* * * * *